United States Patent [19]

Stafford

[11] 4,305,341

[45] Dec. 15, 1981

[54] SPINDLE MOORED SHIP

[75] Inventor: Donald C. Stafford, Hinsdale, Ill.

[73] Assignee: Chicago Bridge & Iron Company, Oak Brook, Ill.

[21] Appl. No.: 82,917

[22] Filed: Oct. 9, 1979

[51] Int. Cl.[3] ..... B63B 21/00

[52] U.S. Cl. ..... 114/230; 308/187; 308/236

[58] Field of Search ..... 9/8 P; 114/230, 264; 308/187, 236; 175/5, 7; 166/352–355; 141/387, 388, 279

[56] References Cited

U.S. PATENT DOCUMENTS

| | | | |
|---|---|---|---|
| 2,969,879 | 1/1961 | Belcher | 308/187 X |
| 3,082,440 | 3/1963 | Rhedin | 114/230 |
| 3,208,804 | 9/1965 | Stenert et al. | 308/236 X |
| 3,237,220 | 3/1966 | Brandt | 9/8 P |
| 3,366,982 | 2/1968 | Sutton | 9/8 P |
| 3,590,407 | 7/1971 | Bratianu | 9/8 P |
| 3,735,435 | 5/1973 | Mikulicic | 9/8 P |

*Primary Examiner*—Sherman D. Basinger

*Attorney, Agent, or Firm*—Merriam, Marshall & Bicknell

[57] ABSTRACT

A mooring system for a vessel comprising a floatable vessel having a vertical well therein, extending through the vessel bottom, defined by a bulkhead; a vertical spindle supported by the vessel within the well; the spindle being anchorable in place in water against significant lateral movement and against rotation about a vertical axis; and machined bearing retaining and contacting sleeves, cooperatively supported by the well bulkhead and the spindle, containing radial-thrust bearings at the top and bottom side portions of the spindle and vertical-thrust bearings along the side of the spindle. The bearings are maintained immersed in lubricant to protect them, such as from sea water.

8 Claims, 13 Drawing Figures

FIG. 10
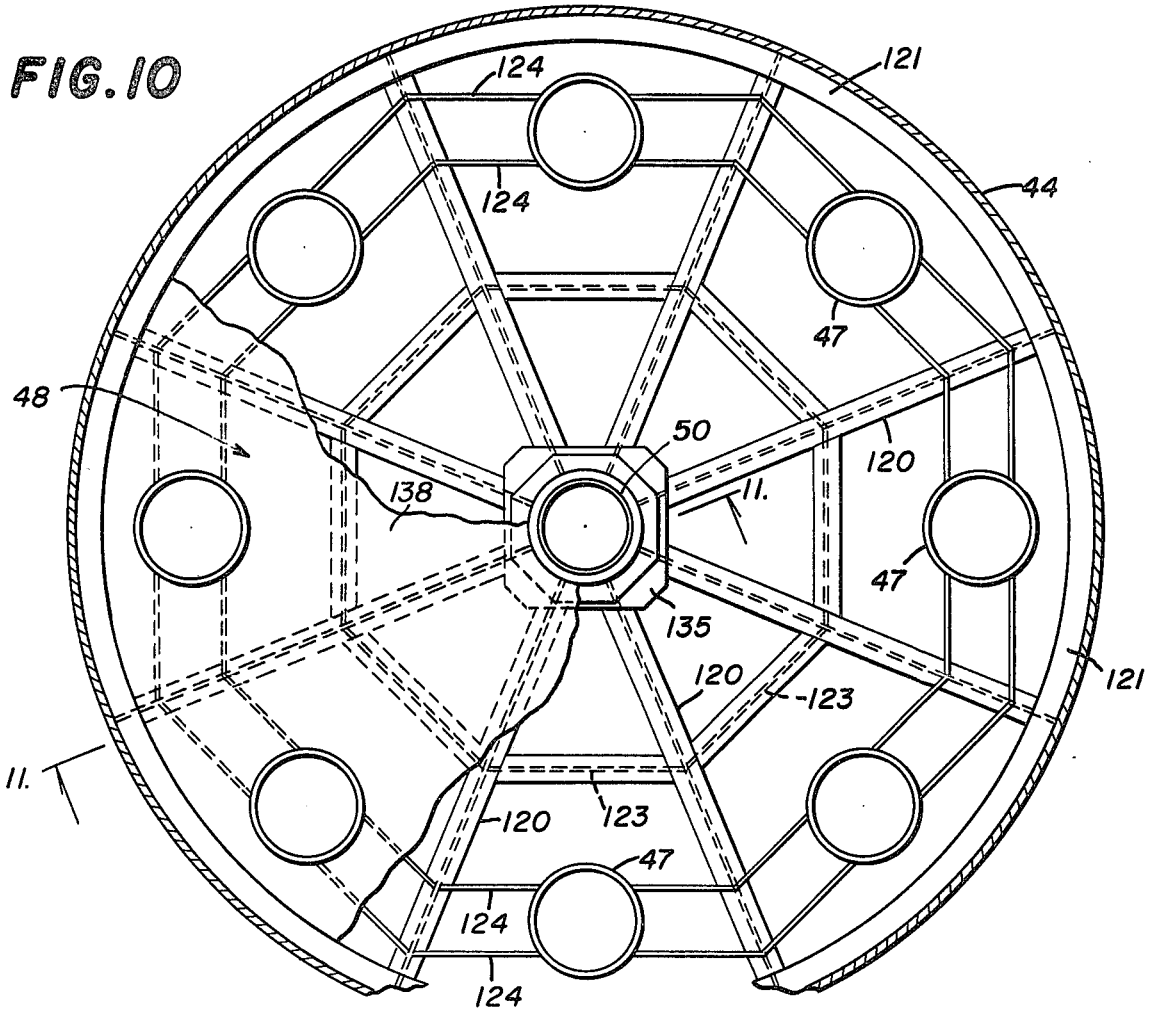
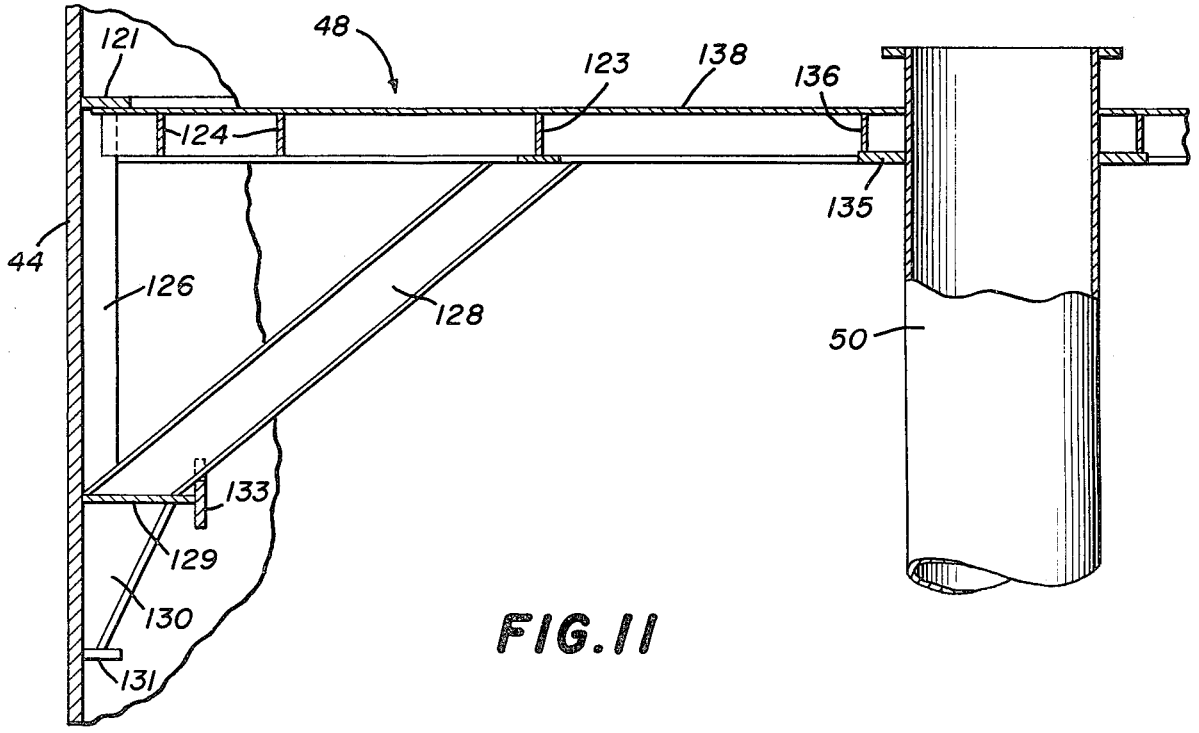
FIG. 11

SPINDLE MOORED SHIP

This invention relates to apparatus for mooring vessels, such as ships and barges. More particularly, this invention relates to the offshore, substantially permanent, deep-water mooring of a vessel by means of apparatus which permits the vessel to weathervane freely.

The offshore mooring of a vessel, on a more or less permanent basis, has become increasingly important for a number of reasons. Thus, the offshore production of oil at substantial distances from land often makes it impractical to install a pipeline on the sea floor so that the oil produced from offshore wells can be pumped directly to shore for storage and/or further transportation or processing. Oil produced offshore under such circumstances is more conveniently delivered by short feeder pipelines to a moored dedicated vessel, such as an aged or unused oil tanker, where it can be stored until transshipped. Substantially permanently mooring a vessel offshore presents many problems, including anticipated storm conditions in the mooring location, as well as the water depth.

It is recognized as desirable for a substantially permanently moored vessel to be capable of weathervaning so that it will always face into existing seas and wind. Because of anticipated storm conditions at potential mooring sites, it is generally not suitable for permanent mooring to use conventional ship anchors and mooring hawsers or wire rope for that purpose because of the large size which would be required. A more suitable mooring system for an offshore vessel which permits it to weathervane employs a pivotting means of one or more different types which is integrally built into the moored vessel. Such mooring systems are disclosed in the following U.S. Pat. Nos.: 3,279,404; 3,440,671; 3,601,075; 3,602,175; 3,605,668; 3,620,181; 3,774,562; 4,130,077; and 4,133,283.

One of the inherent difficulties with such substantially permanent mooring systems is to provide an integral pivot arrangement which is sufficiently strong and rugged to hold the moored vessel in position under anticipated storm conditions but which permits the vessel to weathervane about a vertical pivot, which is essentially stationary, with minimum torque. Because of the large size of the moored vessel and the pivot around which the vessel must rotate, the pivot structure has been fabricated from many parts and elements. This often requires welding of assemblies in order to fabricate the desired mooring apparatus. Welding often causes distortion of the metal pieces used and, in addition, the large size of the fabricated pieces often makes it impossible to produce them with close tolerances. As a result, the bearing arrangements used to handle radial and vertical thrusts have had to be made with significantly large tolerances, which is disadvantageous because of the significant amount of play involved between the pivot and the moored vessel. This causes adverse effects on the weathervaning of the vessel and also induces localized stresses because the forces are not so evenly distributed over the stationary pivot.

Most pivots used offshore in deep water are secured in place by a plurality of lines made of wire rope or chains which extend downwardly and radially outwardly to anchoring means on the sea floor. Such a system will not readily resist torque applied on the pivot by a weathervaning vessel so that unless the bearing means permits easy rotation between the vessel and the pivot, the anchoring chains or other anchoring lines can become twisted. A need accordingly exists for an offshore mooring system which permits low torque weathervaning of a vessel in accordance with prevailing sea and atmospheric conditions.

According to the present invention there is provided an offshore mooring system for a vessel comprising, in combination, a floatable vessel having a vertical well therein, extending through the vessel bottom, defined by a bulkhead; a vertical spindle supported by the vessel within said well; said spindle having means to anchor it in place in water against significant lateral movement and against rotation about a vertical axis; and machined bearing retaining and contacting means, cooperatively supported by the well bulkhead and the spindle, containing radial-thrust bearings at the top and bottom side portions of the spindle and vertical-thrust bearings along the side of the spindle.

The described mooring system desirably has a space on one side of each bearing retaining means which is closed by sealing means which defines a receiver for bearing lubricant. Conduit means is included for supplying bearing lubricant into the bearings and for also removing the lubricant therefrom to permit periodic changing or replacement of the lubricant. The bearings are, however, desirably always fully immersed in a lubricant to protect them against adverse conditions at sea.

The bearings desirably are of the roller bearing type although sleeve bearings can also be used. Ball bearings can also be used.

By utilizing machined bearing retaining and contacting means, a high degree of accuracy is obtained, thereby producing a spindle supporting system which permits easy weathervaning of the vessel around the spindle while minimizing any torque thereby applied to the spindle.

It is important that the machined bearing retaining and contacting means be positioned in cooperative support by the well bulkhead and the spindle without distorting such bearing retaining and contacting means. Heating of the machined bearing retaining and contacting means should accordingly be avoided, at least to the high temperatures which would be involved in prolonged welding near or adjacent to such bearing means.

Although it is feasible for the machined bearing retaining and contacting means to be secured in place to the well bulkhead and the spindle directly, without welding, it is generally more feasible for the bearing retaining and contacting means to be joined, before being machined, to a pair of unmachined substantially metal cylindrical rings. One ring of each pair is joined to the spindle and the other ring of each pair is joined to the well bulkhead. After the bearing retaining and contacting means are joined, such as by welding, to the pair of unmachined rings, the bearing retaining and contacting means is machined to the size and shape needed for receiving the type of bearings to be employed. Once the machining is completed, the inner ring of each pair of unmachined rings is secured to the spindle, desirably by a securing means which avoids welding, such as by means of a suitable non-metallic chocking material or by means of bolts or other fasteners. The outer ring can be similarly secured to the well bulkhead.

The invention will be described further in conjunction with the attached drawings, in which:

FIG. 10 is a sectional view taken along the line 10—10 of FIG. 5 at the upper part of the spindle;

FIG. 11 is a sectional view taken along the line 11—11 of FIG. 10;

So far as is practical, the same numbers will be used in the various views of the drawings to illustrate the same or similar elements.

Figure 2:
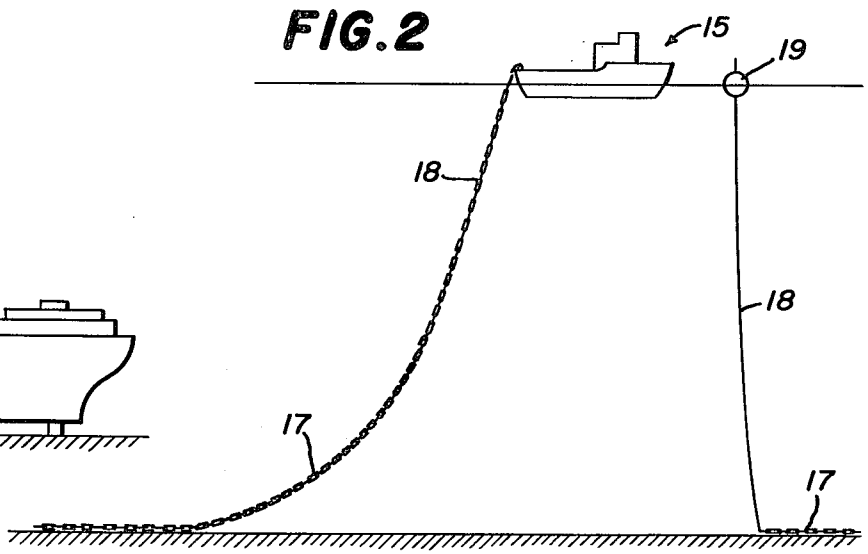
FIG. 2 illustrates schematically how a workboat can handle chains or similar anchoring lines which are to extend from the sea floor to the spindle.
Figure 1:
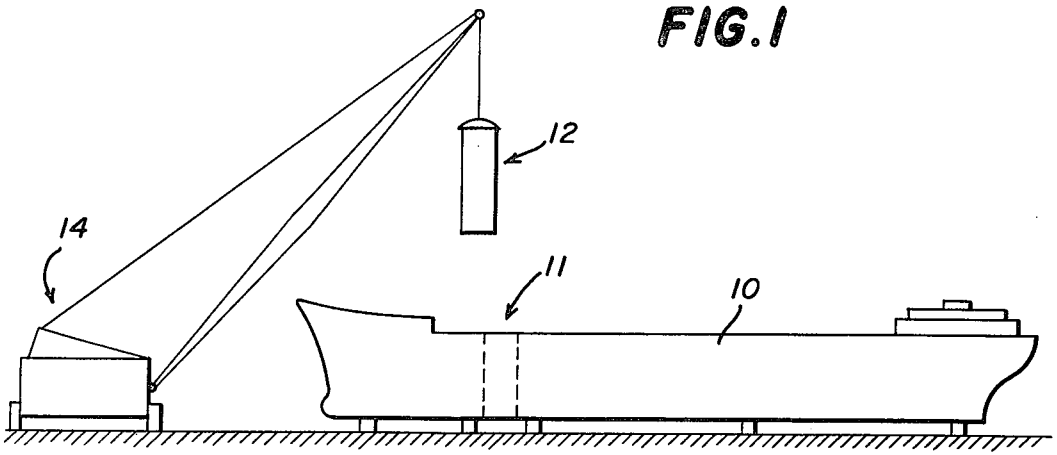
FIG. 1 is an elevational view which illustrates how a spindle can be installed in a vessel according to the invention.

FIGS. 1 to 4 together illustrate a method of installing a mooring system, according to the invention, for a vessel to be more or less permanently moored offshore. Vessel 10, which can be a dedicated tanker for example, is brought into a dry dock and a vertical cylindrical well 11 is formed therein, desirably forward of the center of the ship so that when the vessel weathervanes the bow of the ship will face into the prevailing sea and wind. The well 11 extends through the bottom of the ship and is essentially defined by a bulkhead wall 30. The spindle 12 is prefabricated under shop manufacturing conditions and is then transported to the dry dock where it is lifted by crane 14 and lowered into well 11 in vessel 10. The spindle 12 is then secured in place by means which will be more fully described subsequently herein.

During the time that the spindle 12 is being fabricated and installed in vessel 10, workboat 15, as shown in FIG. 2, may be engaged towing spindle anchor chains 17 connected to it. The workboat 15 drags the chains to the location where the vessel 10 is to be permanently moored. The chains are then permitted to temporarily rest on the sea floor. The messenger line 18 is connected to a buoy 19 which floats on the sea surface. The outer ends of the chains 17 are then connected to a suitable type of anchor, such as a pile driven into the sea floor or to a large dead-weight suitably positioned on the sea floor.

After the required number of anchoring chains 17 are prepositioned as just described, the vessel 10 containing spindle 12 is brought to the mooring location. Buoy 19 is then brought onto workboat 15 and a messenger line 21 extending from the top of spindle 12 through the interior thereof is extended outwardly and then connected to messenger line 18. The connected messenger lines 21 and 18 are then pulled through spindle 12 by means of a suitable mechanism on a chain tensioner derrick 23 mounted on vessel 10 over the upper end of spindle 12. The messenger lines pass through a chain tensioner 25 and then run to windless 26. After the messenger lines 21 and 18 have been pulled through the spindle and onto the windless, the chain 17 is brought up to and into engagement with the chain tensioner 25. The chain is then locked in place by means of a chain-lock 27.

Figure 4:
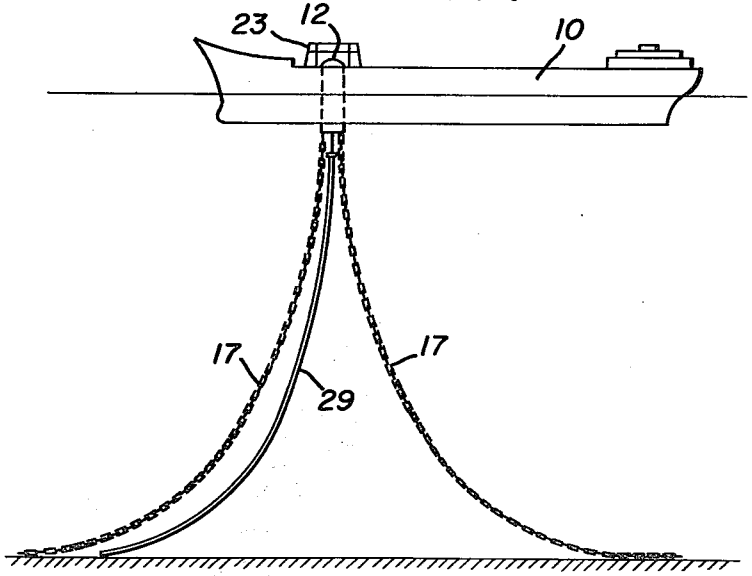
FIG. 4 illustrates a vessel containing a spindle according to the invention which is moored in place with anchoring chains extending from the spindle to the sea floor.
Figure 3:
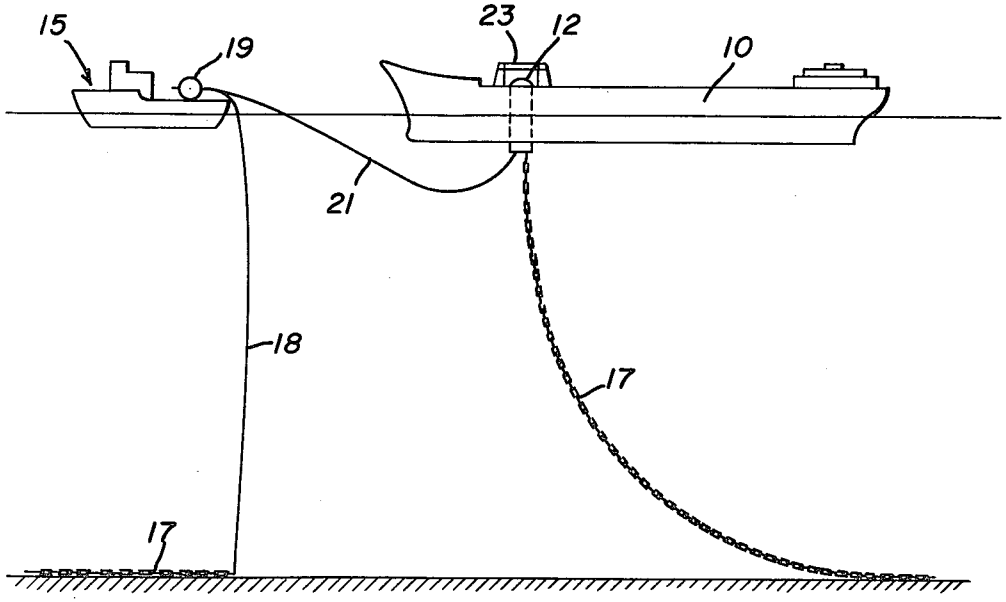
FIG. 3 is a schematic illustration further showing how the spindle anchoring lines can be connected from the sea floor to the spindle in a vessel.

FIG. 4 illustrates the vessel 10 permanently moored at a location, but free to weathervane around spindle 12 which does not rotate and which does not move appreciably in any radial or lateral direction. After the vessel is moored as shown in FIG. 4, a flexible flowline 29 can be run from the sea floor through the flowline guide tube 50 in the center of the spindle 12. The flowline 29 can be used for delivery of oil from offshore wells to the vessel 10 for storage.

Figure 5:
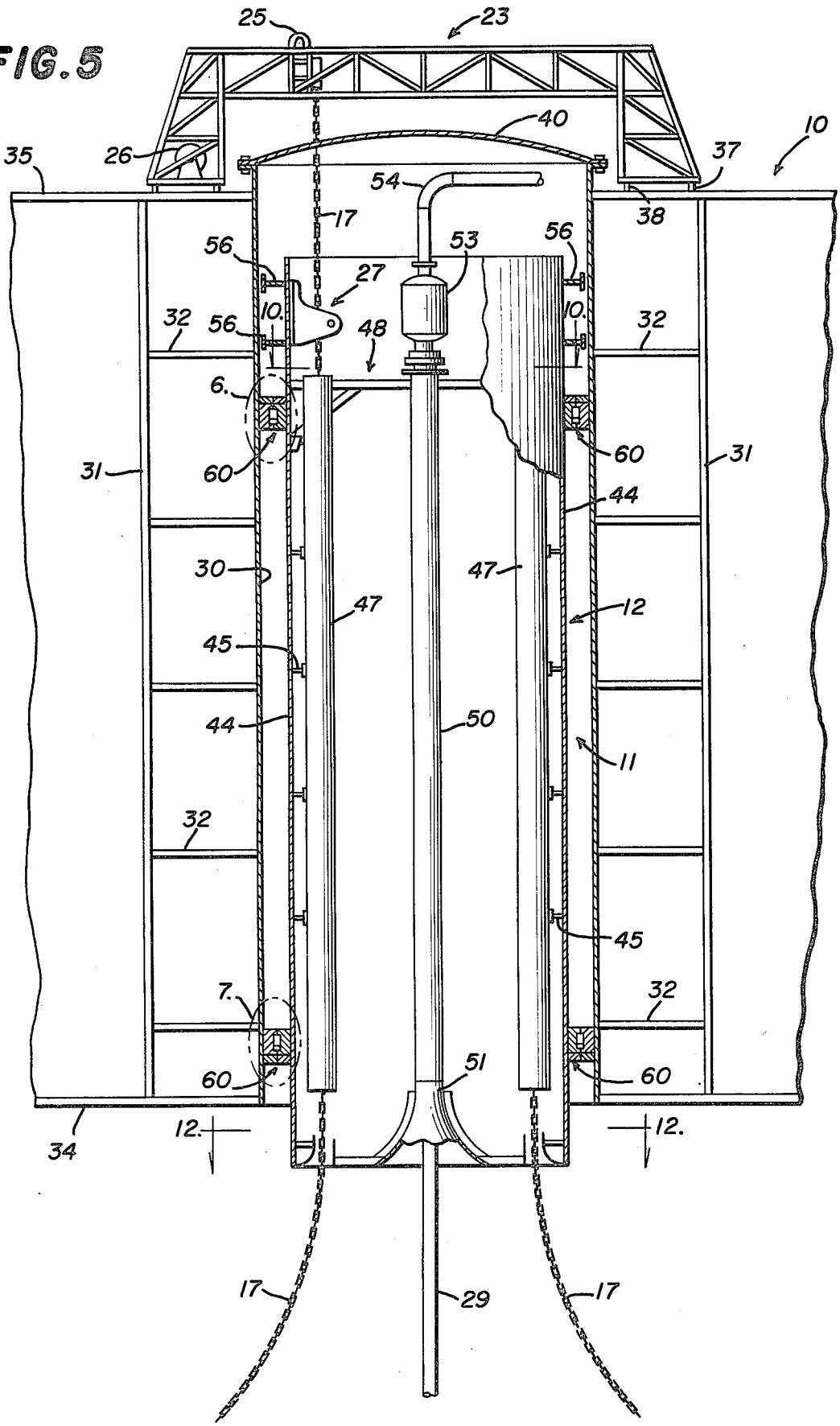
FIG. 5 is a vertical view, partially broken away and partially in section, through a spindle according to the invention positioned in a vessel.

FIG. 5 shows, in more detail, spindle 12 located in well 11 of vessel 10. The well 11 is defined by a bulkhead wall 30 made of metal plate in vertical cylindrical circular shape. The bulkhead wall 30 extends through the entire height of the ship. Bulkhead wall 30 is reinforced by vertical plates 31 and horizontal plates 32. Reinforcing plate 31 extends from the ship bottom 34 to the vessel deck 35. Well 11 is optionally covered by a roof 40.

The derrick 23 is mounted on wheels which roll on rails 37 and 38 so that it can be rotated axially around the top of the spindle 12 to thereby orient chain tensioner 25 directly above one of the eight chains being tensioned. After each chain 17 is tensioned, and chain-lock 27 is engaged, the chain can be released from the chain tensioner 25.

The spindle 12, as shown in FIG. 5, has a vertical cylindrical circular metal shell 44 which is internally reinforced by T-shaped rings 45 spaced at different heights along the inner surface of the shell. Eight equally spaced-apart vertically positioned chain guide tubes 47 extend from near the bottom of spindle shell 44 up to the valve chamber deck 48. Flowline guide tube 50 is axially positioned in spindle shell 44 and it extends upwardly from the bell-shaped bottom 51 to above valve chamber deck 48. Flowline 29 extends through flowline guide tube 50 to fluid swivel 53. Conduit 54 extends from the top of swivel 53 to a manifold for distributing oil to the various storage compartments in vessel 10.

The upper outside portion of spindle shell 44 is reinforced with Tee-members 56 which extend completely around the spindle shell.

Figure 6:
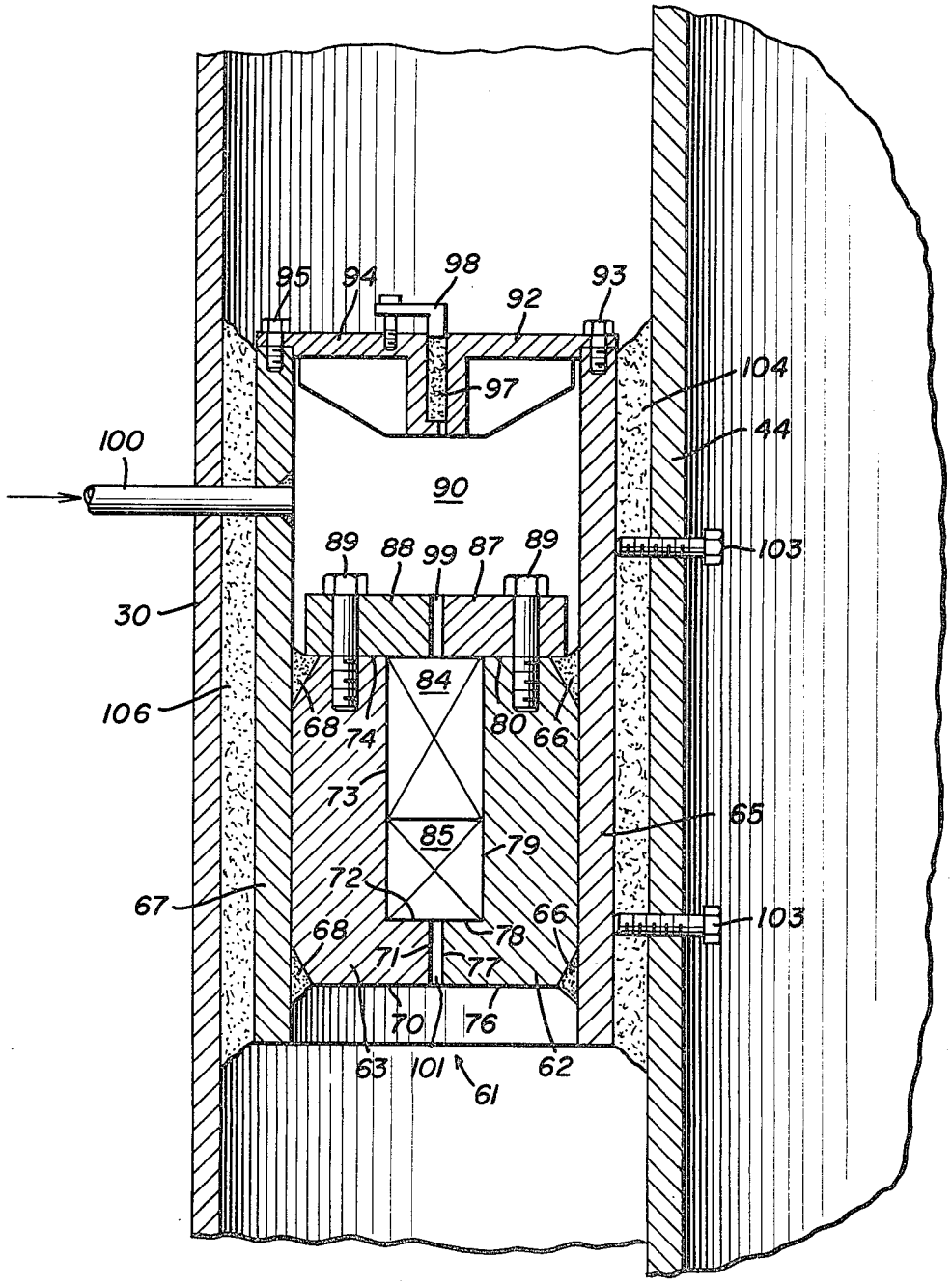
FIG. 6 is an enlarged view of one of the upper bearing units employed on the spindle of FIG. 5.
Figure 7:
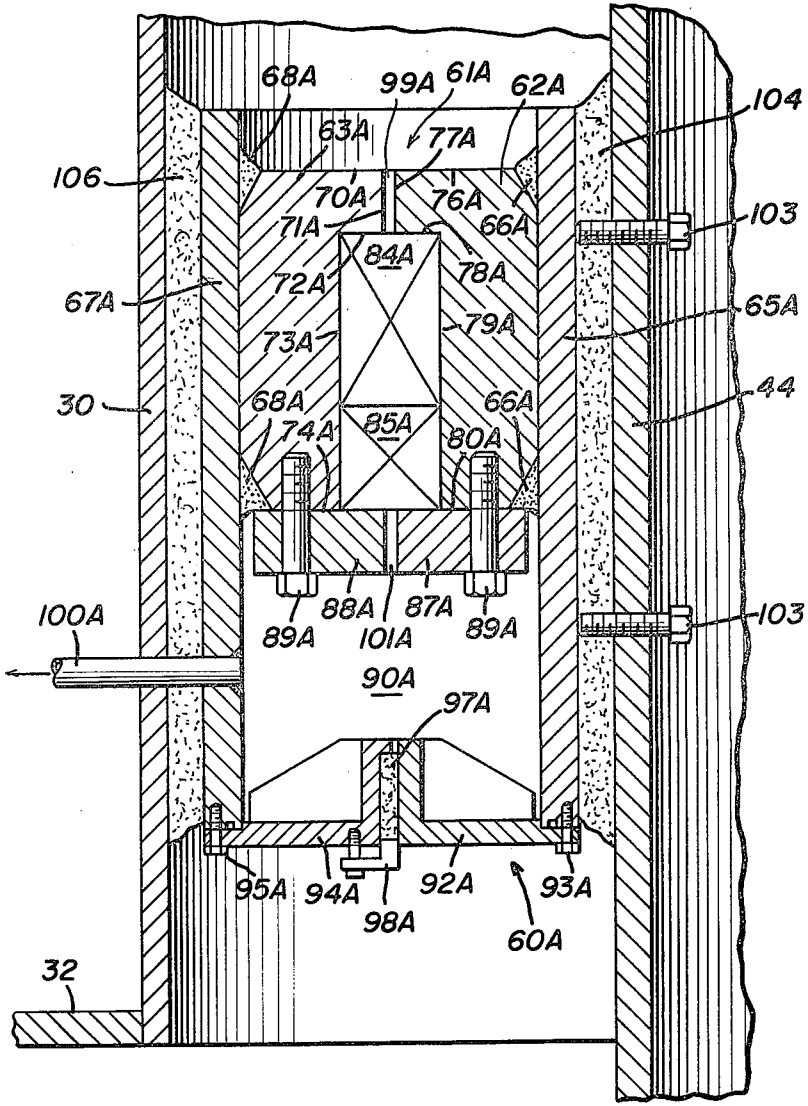
FIG. 7 is an enlarged view of one of the lower bearing units employed on the spindle of FIG. 5.

The vessel 10 is capable of rotating around essentially stationary spindle 12 by means of upper bearing system 60 as shown in FIG. 6, and lower bearing system 60A as shown in FIG. 7, located between the spindle shell 44 and ship bulkhead wall 30.

As shown in FIG. 6, upper bearing system 60 has machined bearing retaining and contacting means 61 formed of a pair of horizontally positioned, vertically telescoped bearing retaining sleeves 62 and 63. Sleeve 62, which is generally circular, is connected to unmachined inner metal ring 65 by welds 66 before the sleeve 62 is machined. Similarly, sleeve 63 is joined to unmachined outer ring 67 by welds 68 before the sleeve 63 is machined. After the sleeves are joined to the rings as described, the surfaces 70, 71, 72, 73 and 74 of outer sleeve 63 are very accurately machined. Similarly, the surfaces 76, 77, 78, 79 and 80 of inner sleeve 62 are very accurately machined.

Radial roller bearings 84 are positioned between the inner and outer sleeves 62 and 63. Vertical thrust roller bearings 85 are positioned below radial bearings 84. Such a combination of radial and thrust roller bearings is used industrially and bearing arrangements of this type are available from Messinger Bearings, Inc., Philadelphia, Pa. Circular plates 87 and 88 are bolted to the top of sleeves 62 and 63 to hold bearings 84 and 85 in place. Bolts 89 are used for this purpose.

A lubricant receiver 90 is provided above the bearing holding sleeves 62 and 63. Angle member 92 is connected by bolts 93 to the top of ring 65. Similarly, angle member 94 is connected by bolts 95 to the upper end of ring 67. Packing 97 is placed between the vertical legs of angles 92 and 94 to prevent bearing lubricant from escaping. The packing is held in place by gland 98. Lubricant is supplied by conduit 100. The lubricant enters the bearings through space 99 and flows out through space 101 into well 11. The lubricant then flows from well 11 to the lower bearing system 60A.

After a bearing system 60 is formed as described, it is positioned in place around spindle wall 44. Adjusting bolts 103 are used to center the bearing system around spindle wall 44. A chocking material 104 is then used to fill the space between ring 65 and spindle wall 44 and to bond the bearing unit to the spindle. A commercially available epoxy based chocking material can be used for this purpose.

As shown in FIG. 7, lower bearing system 60A has machined bearing retaining and contacting member 61A formed of a pair of horizontally positioned, vertically telescoped bearing retaining sleeves 62A and 63A. Sleeve 62A, which is generally circular, is connected to unmachined inner metal ring 65A by welds 66A before the sleeve 62A is machined. Similarly, sleeve 63A is joined to unmachined outer ring 67A by welds 68A before the sleeve 63A is machined. After the sleeves are joined to the rings as described, the surfaces 70A, 71A, 72A, 73A and 74A of outer sleeve 63A are very accurately machined. Similarly, the surfaces 76A, 77A, 78A, 79A and 80A of inner sleeve 62A are very accurately machined.

Radial roller bearings 84A are positioned between the inner and outer sleeves 62A and 63A. Vertical thrust roller bearings 85A are positioned below radial bearings 84A. Circular plates 87A and 88A are bolted to the bottom of sleeves 62A and 63A to hold bearings 84A and 85A in place. Bolts 89A are used for this purpose.

A lubricant receiver 90A is provided beneath the bearing holding sleeves 62A and 63A. Angle member 92A is connected by bolts 93A to the bottom of ring 65A. Similarly, angle member 94A is connected by bolts 95A to the lower end of ring 67A. Packing 97A is placed between the vertical legs of angles 92A and 94A to prevent bearing lubricant from escaping. The packing is held in place by gland 98A. Lubricant enters the bearings from well 11 through space 99A and flows out through space 101A into receiver 90A from which it is withdrawn by means of conduit 100A as shown in FIG. 7.

After a lower bearing system 60A is formed as described, it is positioned in place around spindle wall 44. Adjusting bolts 103 are used to center the bearing system around spindle wall 44. A chocking material 104 is then used to fill the space between ring 65 and spindle wall 44 and to bond the bearing unit to the spindle.

After the upper and lower bearing systems have been positioned on the outside of spindle wall 44, the spindle can be positioned in place in the vessel well 11. Of course, lubricant supply conduit 100, and lubricant withdrawal conduit 100A, would not be in place at that time since they would extend to the bulkhead 30 and would prevent lowering of the spindle into the well. After the spindle has been put in position in the well, a chocking material 106 (FIGS. 6 and 7) can be positioned between ring 67 and bulkhead wall 30 to secure those two elements in place. Chocking 106 can also be a commercially available material and it too can be epoxy based chocking compound.

By securing each bearing system 60 and 60A in place without in any way distorting the bearing system or its components, such as by the application of heat through welding, a very easily rotatable system is created which permits the vessel to weathervane unusually freely about the anchored spindle. Furthermore, by wholly immersing the bearings in lubricant they are protected from the environment, particularly sea water, and as a result will function properly with little maintenance for a long time.

Figure 8:
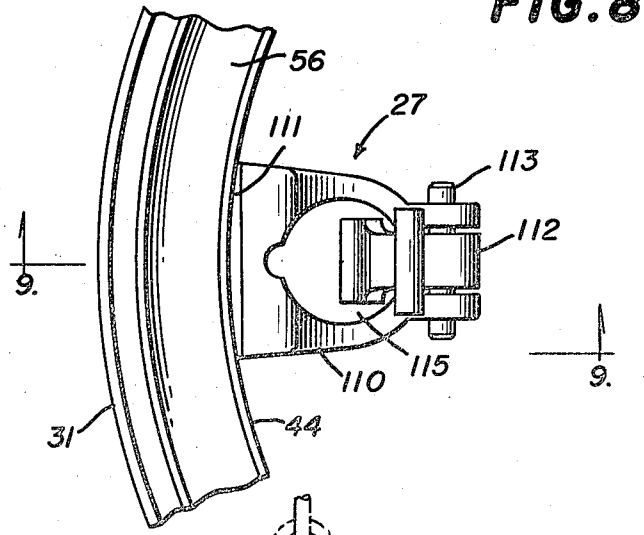
FIG. 8 is a plan view of an anchoring chain stopper located inside of the spindle near the top.
Figure 9:
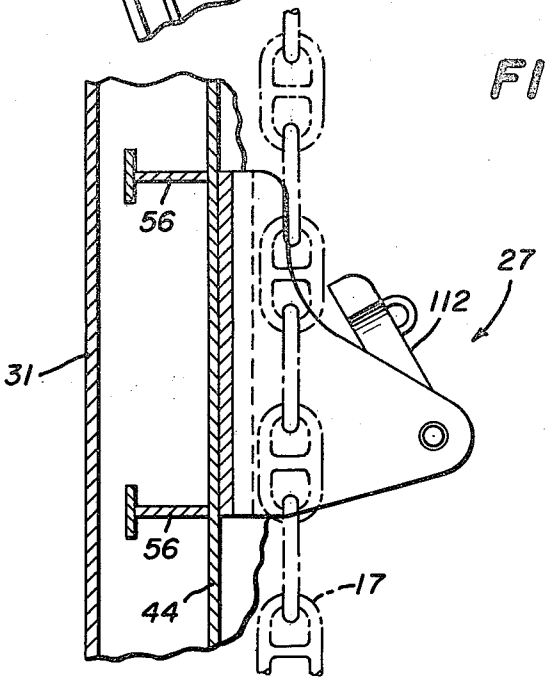
FIG. 9 is a view taken along the line 9—9 of FIG. 8.

FIGS. 8 and 9 show details of the chain stopper 27. Base 110 is secured through an intermediate spacer 111 to the inside surface of spindle shell 44. Dog 112 is pivotally mounted on axle 113. The chain 17 passes through opening 115 in base 110. When the desired tension is applied to chain 17, the dog 112 is permitted to fall forward and downwardly into contact with the chain 17. The weight of the chain and any force applied to the chain below the chain stopper 27 pulls the dog 112 even more tightly against the chain and thus holds it in place.

FIGS. 10 and 11 of the drawings illustrate structural details of the valve chamber deck 48. Eight Tee-beams 120 extend radially outwardly from flowline guide tube 50 to ring plate 121 positioned horizontally along the inside surface of spindle shell 44. Inverted Tee-sections 123 extend between each two adjoining radially located Tee-beams 120. Similarly, spaced-apart parallel vertical plates extend from radially positioned Tee-beams 120 to the chain guide tubes 47. Vertical plates 126 project downwardly from ring 121 beneath each of the radially positioned Tee-beams 120, and I-beam 128 extends at an angle from the lower part of vertical plate 126 to beneath each inverted Tee-beam 123. Horizontal ring plate 129 supports the lower end of I-beam 128 as does vertical plate 130 and reinforcing plate 131. Plate 133 at the end of ring plate 129 is also provided for stiffening. Plate 135 is positioned around the upper part of flowline guide 50. Vertical plate 136 extends upwardly from plate 135 and supports the inner portion of valve chamber deck plate 138.

Figure 12:
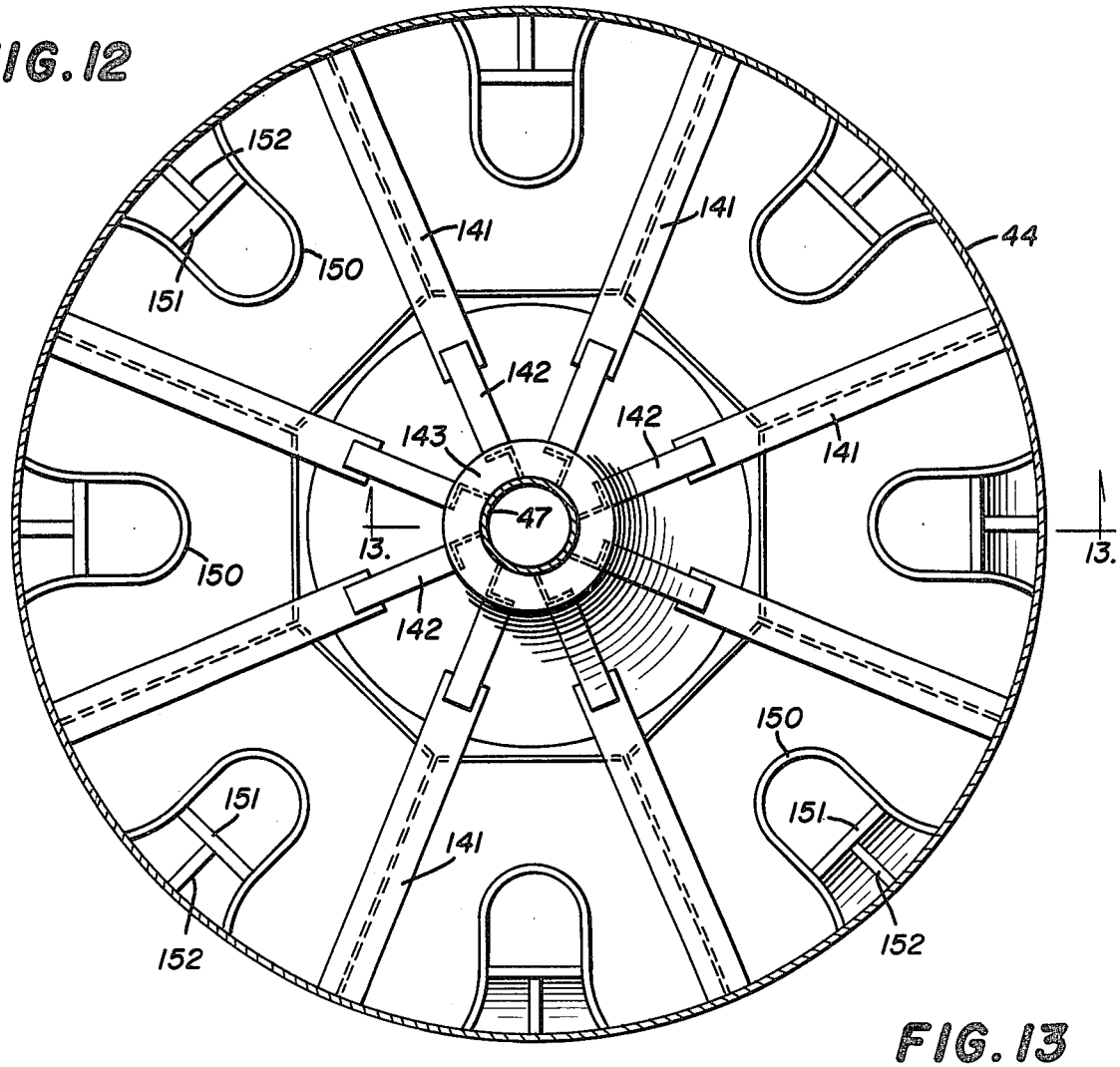
FIG. 12 is a sectional view taken along the line 12—12 at the bottom of FIG. 5.
Figure 13:
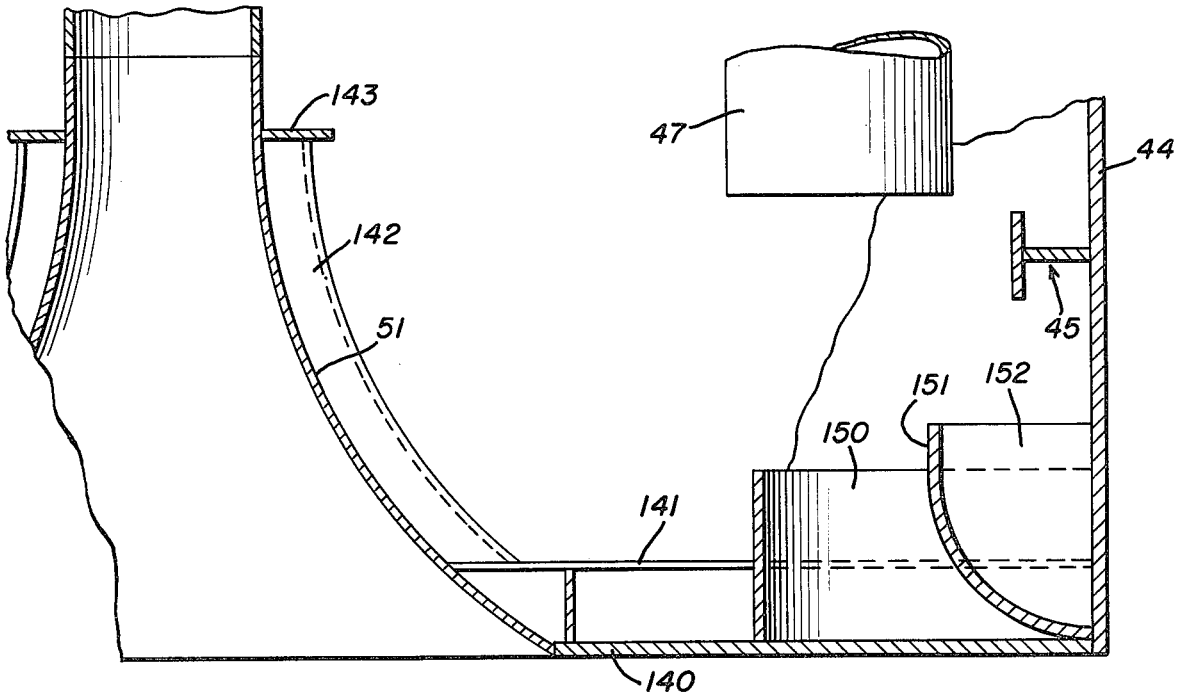
FIG. 13 is a sectional view taken along the line 13—13 of FIG. 12.

FIGS. 12 and 13 give details of the lower part of the spindle and the structure used to guide the anchor chains and the flowline 29. Extending outwardly from the bottom edge of spindle shell 44 is a series of eight radially positioned horizontal plates 140 which extend to and are joined to the lower edge of the bell-shaped lower portion 51 at the bottom of flowline guide 50. Above each horizontal plate 140 is positioned a Tee-shaped member 141. Eight right-angle members 142 extend upwardly, following the contour of bell-shaped member 51, from the top of Tee-beam 141 to circular plate 143.

Eight radially positioned and equally spaced-apart chain guides 150 are joined to the inner surface of spindle shell 44. The chain guides 150 are vertically positioned members which are more or less U-shaped in plan view. Each chain guide 150 has a curved slide plate 151 located therein. The slide plate 151 arcs outwardly towards the spindle shell 44 as it extends downwardly. The slide plate 151 is reinforced by a vertical plate 152.

The foregoing detailed description has been given for clearness of understanding only, and no unnecessary limitations should be understood therefrom, as modifications will be obvious to those skilled in the art.

What is claimed is:

1. A mooring system for a vessel comprising, in combination:

a floatable vessel having a vertical well therein, extending through the vessel bottom, defined by a bulkhead;

a vertical spindle supported by the vessel within said well;

said spindle having means to anchor it in place against lateral movement in water;

a first pair of horizontally positioned, vertically telescoped bearing retaining inner and outer sleeves, having machined opposing spaced-apart surfaces, located near the top of the spindle, and with the inner sleeve joined to the outside of an inner ring and the outer sleeve joined to the inside of an outer ring;

a second pair of horizontally positioned, vertically telescoped bearing retaining inner and outer sleeves, having machined opposing spaced-apart surfaces, located near the bottom of the spindle, and with the inner sleeve joined to the outside of an inner ring and the outer sleeve joined to the inside of an outer ring;

bearings retained by the first and second pair of inner and outer sleeves;

said sleeves being joined to their respective rings prior to machining the sleeves; and said inner rings being joined to the spindle, and said outer rings being joined to the vessel well bulkhead, by non-welding means which avoids distorting the sleeves and rings.

2. A mooring system according to claim 1 in which a space, on one side of each bearing retaining inner and outer sleeves, between the rings is closed by sealing means which permits the rings to rotate relative to each other and defines a receiver for bearing lubricant.

3. A mooring system according to claim 2 including means for supplying lubricant to the bearings and removing it therefrom.

4. A mooring system according to claim 1 in which the space between the spindle and the well bulkhead is filled with lubricant between the bearings at the top and bottom side portions of the spindle.

5. A mooring system according to claim 1 in which the bearings are roller bearings.

6. A mooring system according to claim 1 in which the bearings are ball bearings.

7. A mooring system according to claim 1 in which the bearings are fully immersed in a lubricant.

8. A mooring system according to claim 1 in which each ring joined to the spindle, and each ring joined to the well bulkhead, is joined thereto by non-metallic chocking.

* * * * *